US006205823B1

(12) United States Patent
Volk, Sr.

(10) Patent No.: US 6,205,823 B1
(45) Date of Patent: Mar. 27, 2001

(54) GOLF BAG SECURITY DEVICE

(75) Inventor: Thomas Volk, Sr., 4401 Pamona St., Ventura, CA (US) 93003

(73) Assignee: Thomas Volk, Sr., Ventura, CA (US)

( * ) Notice: Subject to any disclaimer, the term of this patent is extended or adjusted under 35 U.S.C. 154(b) by 0 days.

(21) Appl. No.: 09/377,444

(22) Filed: Aug. 19, 1999

Related U.S. Application Data

(60) Provisional application No. 60/097,145, filed on Aug. 19, 1998.

(51) Int. Cl.[7] ..... E05B 69/00

(52) U.S. Cl. ..... 70/58; 248/96; 211/4; 211/70.2; 312/265.3

(58) Field of Search ..... 70/14, 18, 19, 70/57–62; 312/265.3; 248/551–553, 96; 211/4, 8, 12, 60.1, 62, 63, 65, 68, 70.2, 85

(56) References Cited

U.S. PATENT DOCUMENTS 1,660,479 * 2/1928 Crowe ..... 312/265.3
2,278,232 * 3/1942 Anderson ..... 312/265.3
2,639,208 * 5/1953 Obenchain ..... 312/265.3 X
2,902,238 * 9/1959 Tolman ..... 248/96
2,963,165 * 12/1960 Steiner ..... 211/4
3,768,662 * 10/1973 Ritzen ..... 211/4
4,132,315 * 1/1979 Young ..... 211/4
4,174,042 * 11/1979 Fair ..... 211/8
4,508,229 * 4/1985 Yost, Jr. ..... 211/4 X
4,986,425 * 1/1991 Gohl ..... 211/4
5,076,651 * 12/1991 White ..... 312/265.3
5,178,444 * 1/1993 May et al. ..... 211/4 X
5,191,978 * 3/1993 Strader et al. ..... 248/96 X
5,199,581 * 4/1993 Arnold ..... 248/96 X
5,472,101 * 12/1995 Ahrens ..... 211/4
5,497,891 * 3/1996 Hannon ..... 248/96 X
5,551,579 * 9/1996 Converse ..... 211/70.2

* cited by examiner

*Primary Examiner*—Suzanne Dino Barrett
(74) *Attorney, Agent, or Firm*—Marvin E. Jacobs

(57) ABSTRACT

A secure storage locker for temporarily storing golf bags having clubs. The locker includes a base having a recess for receiving the bottom end of a golf bag having the heads of the golf clubs extending above the top end of the bag. A bonnet is slidingly and/or hingedly connected to the base and has a cavity for covering the club heads. Locking means are provided for locking the bonnet to the base.

7 Claims, 3 Drawing Sheets

GOLF BAG SECURITY DEVICE

CROSS REFERENCE TO RELATED APPLICATION

This application is related to and claims the benefit of U.S. Provisional Application Ser. No. 60/097,145 filed Aug. 19, 1998.

TECHNICAL FIELD

This invention relates to storage lockers and more specifically to lockers suitable for temporarily storing golf bags containing clubs and other golf related equipment.

BACKGROUND OF THE INVENTION

Golf is one of the fastest growing sports. People who regularly golf usually invest in expensive equipment such as golf clubs, golf bags, and other related equipment such as shoes, gloves and golf clothing.

Golf is a sport in which delays are common. For example, if the golf course is crowded, the golfer must wait for a starting time which can be for more than an hour. He stays with his equipment or leaves the equipment in an open rack or returns it to his automobile which can be parked far away. Many golfers stop for lunch or a beverage after finishing the front nine holes and starting the back nine hole of a course or after finishing a round of 18 holes. Again, the equipment remains unattended and is many times stolen.

Private golf clubs have lockers for its members and their guests. It is not always convenient to use the lockers and the lockers are usually sized to store clothing—not golf clubs. Many courses have stands to store a bag of clubs while the golfer is eating, drinking, practicing putting or driving.

However, there is usually no security provided and anyone could walk away with the stored clubs. Ski resorts provide locking stands for skis but there is no equivalent product for golf clubs in a bag. Furthermore, the bag with golf clubs having different lengths extending from the top of the bag is not as easy to secure as a set of skis.

STATEMENT OF THE INVENTION

The invention provides a secure device for temporarily storing golf bags. Each device includes a locker which may be single standing or several lockers may be attached to one another in series, back to back, or some other pattern. For security reasons, the locker is preferably secured to a hardened surface such as cement, concrete or metal strips by the use of bolts or other conventional means of attachment.

The locker of the invention includes: a base having a topside recessed surface area sized to receive the bottom of a golf bag; a bonnet having side walls and a top wall forming a bottom side recess for enclosing the portions of golf clubs extending from a golf bag. A vertical support member connects the base at one end to the bonnet at the other end. Preferably, the bonnet is hinged to the support member or at least one vertical wall of the bonnet is hinged to permit it to be either in an open or closed/locked position. Alternatively, the vertical support member may be slightly longer than in the hinged embodiment which permits the bonnet to travel upwardly along an upper portion of the vertical member so that the bonnet can be temporarily moved upwards into an open position above the head of the longest golf club and then downwards into a closed/locked position.

Preferably, the vertical support member also incorporates a locking mechanism such as a hasp which receives a lock.

Preferably, the locking mechanism is a conventional coin-operated locking mechanism similar to those used at airports and bus stations in which a coin is inserted into a slot in the mechanism to permit a key to be removed from the locker face and used to subsequently open the locker or at ski resorts where a coin-operated latch gives access to a ski-storage rack.

The locker is preferably constructed of durable, substantially rigid material to prevent theft. Preferably, the bonnet and base are constructed of molded resin or fiber reinforced resin such as epoxy-fiberglass to minimize damage to the clubs and the golf bag which can occur from scratches or scraping metal edges or surfaces. Fiberglass reinforced resin materials are strong and smooth, yet are much lighter then metal and weather better outside. Although the vertical support member may also be made of either rigid plastic or fiberglass reinforced resin, it is preferably made from a durable, smooth metal such as steel or high strength aluminum.

A golfer wishing to store his bag and clubs in the locker of the invention would insert the required currency into the slot in the coin-operated locking mechanism. The bonnet would release from its locked position and become moveable upon the post or about its hinge into an open position where the bonnet becomes perpendicular with the ground level or displaced from over the base. The golfer then places his golf bag in the cavity in the base so that the bottom of the bag rests within the recessed area of the base. Next, the golfer lowers the bonnet or rotates it about its hinge into the closed, position being careful to direct the club heads into the recessed area of the bonnet so that the side walls of the bonnet will extended over the top of the golf bag in close proximity to the golf bag, yet the club heads extending from the golf bag will be disposed within the bonnet recess. Once in the closed position, the bonnet locks. The golfer removes a key from a keyhole on the locker. The minimum distance between the base and bonnet when in the closed position is such that a golf bag and clubs cannot be removed. The bonnet recess is deep enough to store the extension of the longest club within the recess.

When the golfer desires to remove the bag and clubs from the locker, he inserts the key and rotates it until the locking mechanism releases the bonnet from the locked position. The bonnet can thereafter be lifted or rotated about its hinge allowing the golf bag and clubs to be removed. The key thereafter remains secured in position in the keyhole until another patron inserts a coin to use the device.

In an alternative embodiment, a keyless locking mechanism could be utilized having a keypad and microchip. A patron would insert a coin, position his golf bag as described above, lower the bonnet and thereafter receive a password or number, either by temporary screen display or printout. When wishing to remove his clubs, the patron would enter the number or password onto the keypad attached to the locker. The microchip could provide randomly different numbers or passwords for each subsequent use thereby reducing the risk of theft from a previous user. In a third embodiment, the bonnet and base include a hasp for receiving a mechanical lock opened by a key or a number combination.

The invention provides a golf club storage locker with a simple yet pleasing appearance, suitable for installation at various locations around the clubhouse, restaurant, practice greens, pro shop, etc. A relatively large number of golf bags can be stored in a small area. The lockers are easily operated by coins and therefore accessible for any golfers to use. The locker is formed of materials resistant to sun and rain and sun and can be located outside without the need for shelter.

The golf bag locker of the invention can temporarily secure a golf bag full of clubs eliminating the risk of theft. The golf bag locker of the invention can be manufactured economically and sold or leased at relatively low cost. The golf bag locker can be installed at a variety of locations with minimal installation cost.

These and many other features and attendant advantages of the invention will become apparent as the invention becomes better understood by reference to the following detailed description when considered in conjunction with the accompanying drawings.

DETAILED DESCRIPTION OF THE INVENTION

Figure 2:
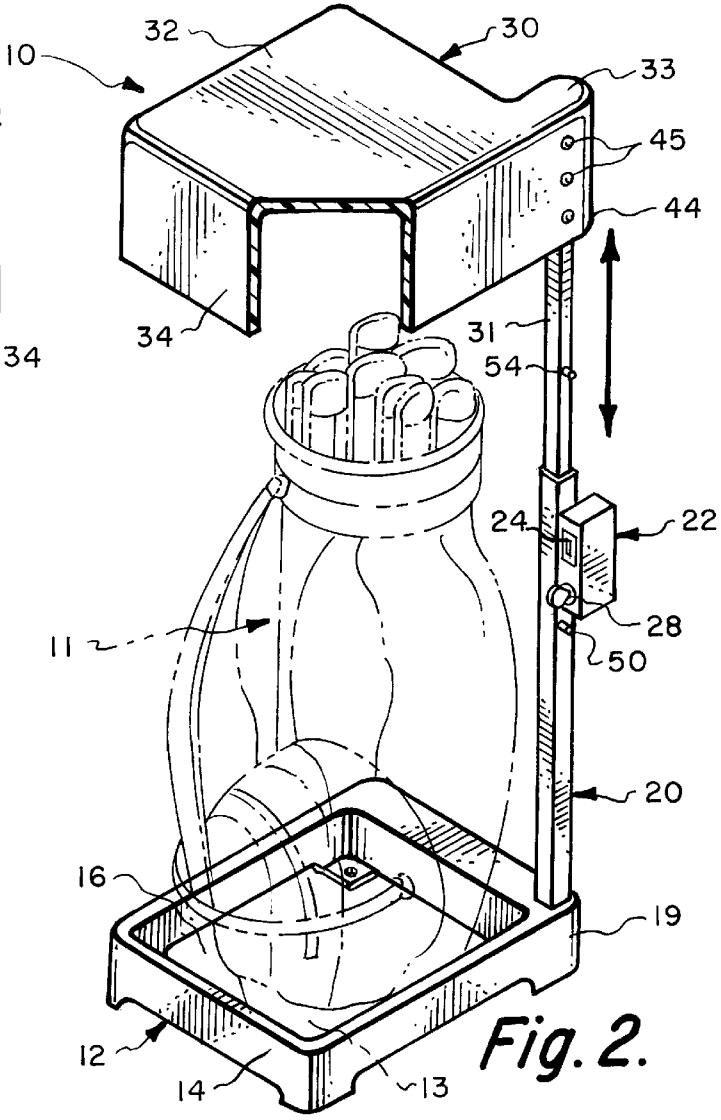
FIG. 2 is a perspective view of the locker of FIG. 1 shown with the support member elevated to position the bonnet above the club heads.
Figure 1:
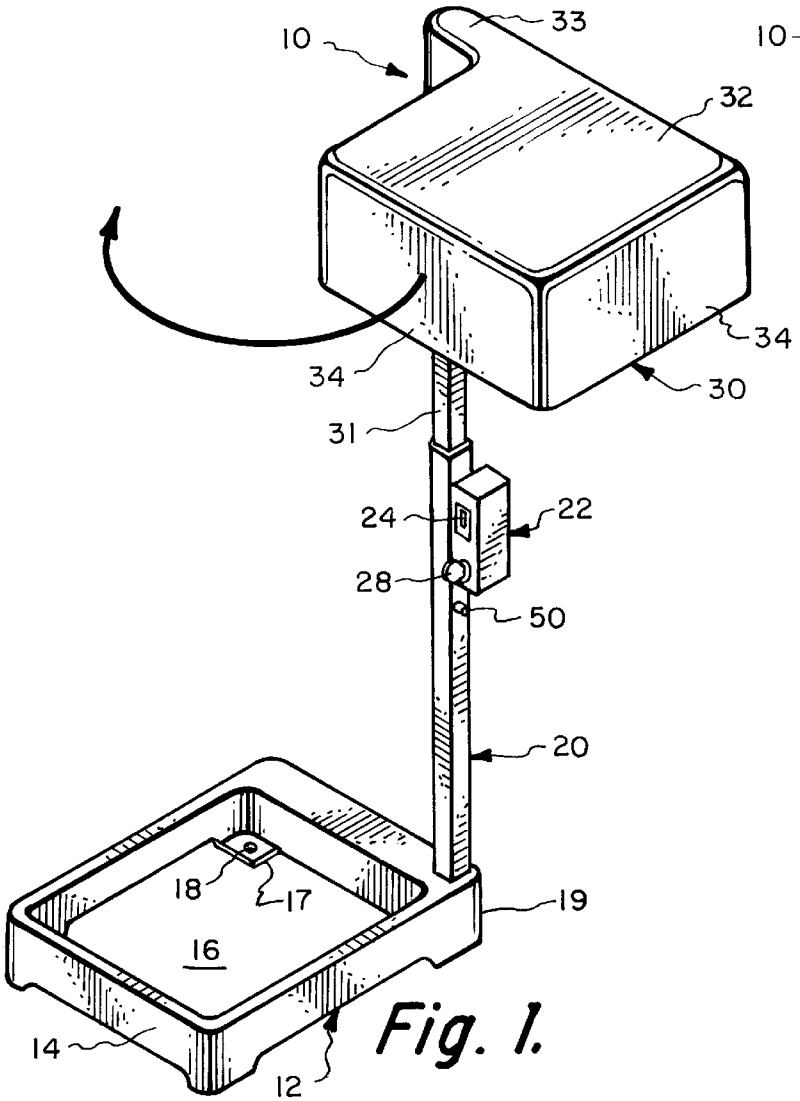
FIG. 1 is a perspective view of a first embodiment of a golf bag locker according to the invention with the bonnet shown in lower position.

Referring now to FIGS. 1–5, a first embodiment of a golf bag locker 10 is illustrated. The locker 10 is formed of a base 12, vertical support member 20 and a bonnet 30. The base 12 has vertical perimeter walls 14 forming a recessed cavity 16 for receiving the bottom portion 13 of a golf bag 11 as shown in FIG. 2. The base 12 can contain at least one bottom flange 17 having a mounting hole 18 for receiving screws or bolts (not shown) for securing locker 10 to a hardened surface (not shown).

The vertical support member 20 is fixedly connected to a corner 19 of the base 20 and the moveable bonnet 30 can be rotatably connected to an inner post 31 slidingly received in the support member 20. The bonnet 30 has a closed top wall 32, side walls 34 and a hinge means 25 received in a corner extension 33 of the bonnet 30 for permitting the bonnet 30 to be rotatably connected to the post 31 slidingly received within the support member 20. The hinge means 25 further permits bonnet 30 to rotate from a horizontal, closed position over the base 12 to an open position displaced from the base as shown in FIG. 2.

Figure 5:
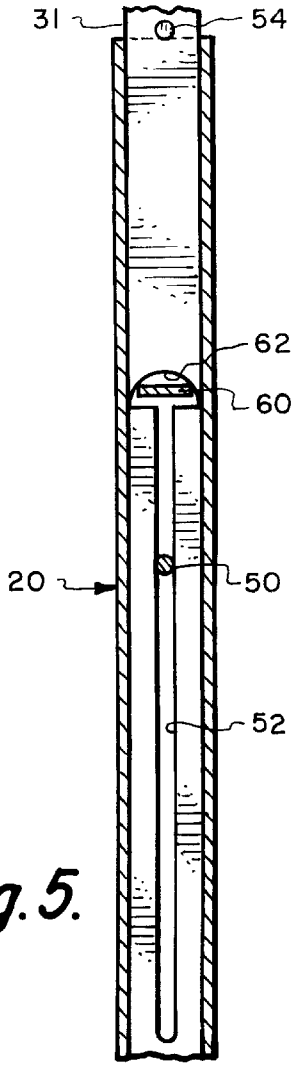
FIG. 5 is a view in section taken along line 5—5 of FIG. 3.
Figure 4:
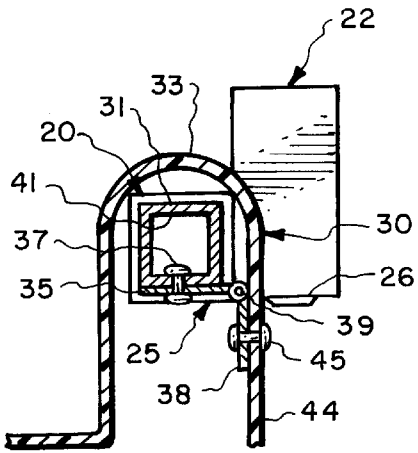
FIG. 4 is a view in section taken along line 4—4 of FIG. 3.
Figure 3:
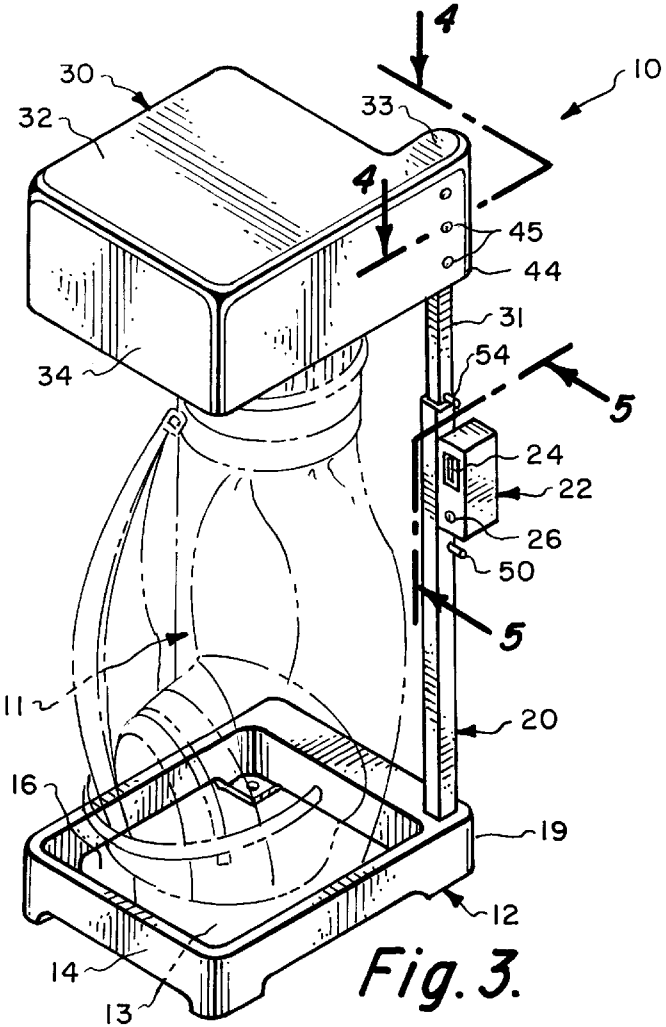
FIG. 3 is a perspective view of the locker of FIG. 1 shown containing a golf club bag with the bonnet in locked position.

As shown in FIGS. 4 and 5, the hinge means 25 has two plates 35, 38 joined by a pin 39. The first plate 35 is secured to the inner wall 41 of the post 31 by means of fasteners such as rivets 37. The second plate 38 is secured to the wall portion 44 of the extension 33 of the bonnet 30 by means of fasteners such as rivets 45. When the bonnet 30 is rotated to the open position, the bonnet 30 will rotate 90° in a horizontal plane until the plates 35, 38 are engaged.

The bonnet 30 can also be moved vertically by pulling the telescoping post 31 out of the support member 20. The pin 50 mounted through the slot 52 prevents the post 31 from being pulled out of the support member 20. The pin 54 mounted on the post 31 acts as a lower stop for the post 31 and bonnet 30.

A coin operated locking mechanism 22 is mounted on support member 20. The coin operated locking mechanism 22 includes a slot 24 for inserting a coin, and a keyhole 26 for inserting and removing a key 28. As shown in FIG. 5, when a coin is placed into the slot 26, the tongue 60 is released from the groove 62 and the key 28 is released from the keyhole 26. When the key 28 is removed from the keyhole 26, the tongue 60 enters the groove 62 which prevents upward movement of the post 31.

A patron would utilize the locker 10 invention by initially inserting the required currency into coin slot 24 of mechanism 22 located on the support member 20. The key 28 can now be removed from the keyhole 26. The locking mechanism 22 releases the post 31 from its horizontal position allowing the patron to raise the bonnet 30 upward and rotate it sideways. The patron next lifts his golf bag 11 into the recess 16 in the base 12. The patron then rotates and lowers the bonnet 30 back into the down position so that the club heads extending from the top of the golf bag are disposed within the recess of the bonnet 30 and are surrounded by top wall 32 and side walls 34. Once back in the position, the post 31 locks and can not be released until the key 28 is inserted back into the keyhole 26 to release the locking means. Once the locking means is released, bonnet 30 can be raised and rotated to expose the club heads and the patron's golf bag and clubs can be removed from the locker 10. Also, once the locking means is released, the key is not removable from the keyhole 26 until currency is again inserted into the coin slot 24.

Figure 6:
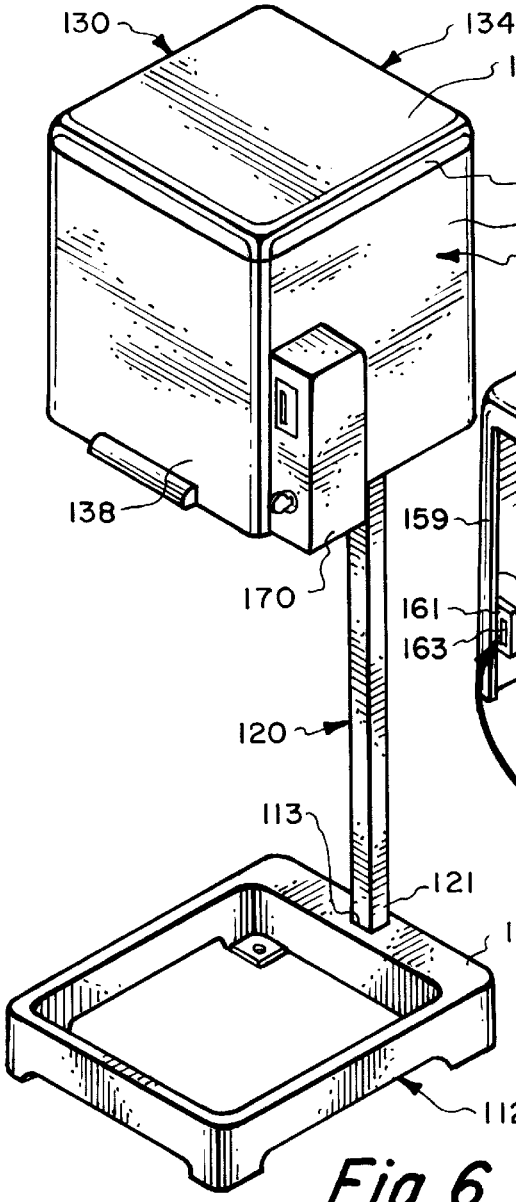
FIG. 6 is a perspective view of a second embodiment of a locker of the invention shown in closed position.
Figure 7:
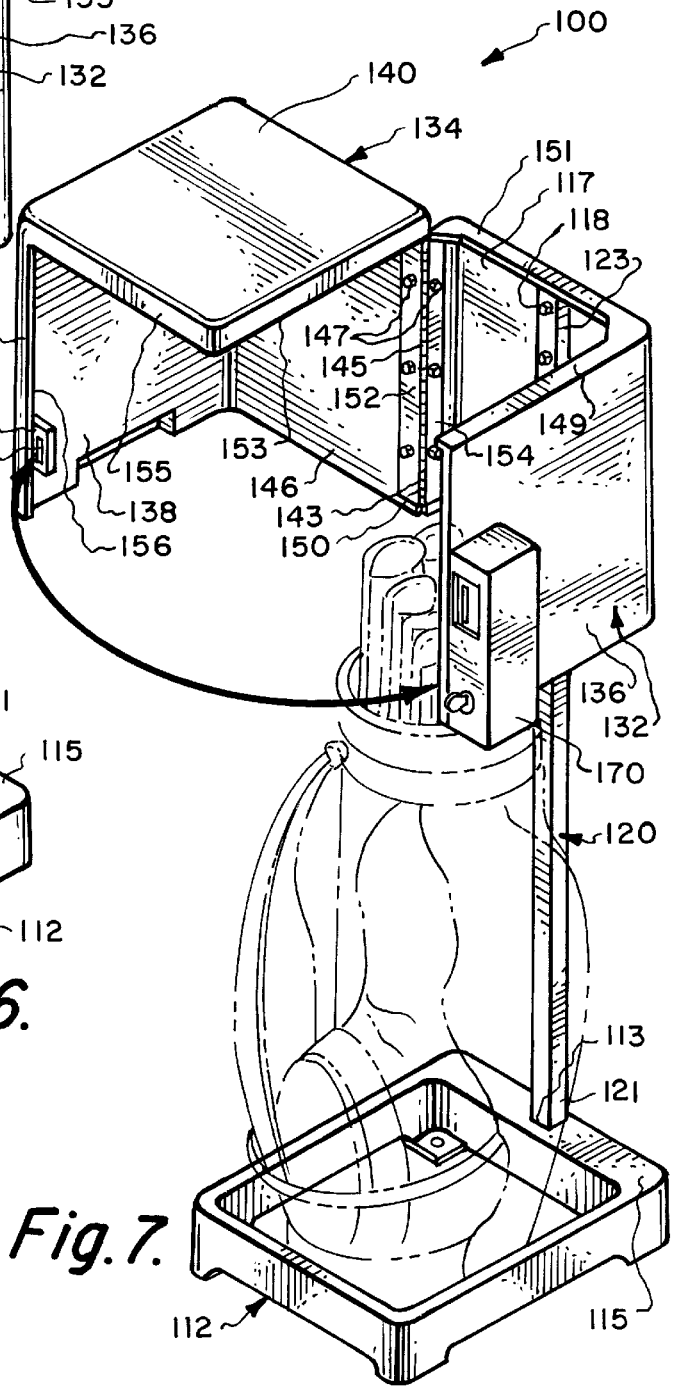
FIG. 7 is a perspective view of the locker of FIG. 6 shown in open position.

Referring now to FIGS. 6 and 7, a second embodiment of a golf bag locker 100 is formed of a base 112, bonnet 130 jointed together by a vertical support member 120. The bottom end 121 of the support member 120 is fixedly mounted in a slot 113 in one of the perimeter walls 115 of the base 112. The top end 123 of the support member 120 is secured to the back wall 117 of the bonnet by fasteners 118. The bonnet 130 is split into 2 L-shaped sections, 132, 134. The first fixed section 132 comprises a side wall 136 and the back wall 117. The second section 134 includes the other side wall 146 and the front wall 138. The top wall can be connected to either of the sections 132, 134. It is preferably connected to the second movable section 134. The sections 132 and 134 are joined along their mating edges 143, 145 by a plate hinge 150 having plates 152, 154 secured to the edges 143, 145 by fasteners 147 such as rivets. The stationary section 132 has horizontal lips 149, 151 across the top of the walls 136, 117. Top wall 140 has vertical lips 153, 155 which rest on the lips 149, 151 when the bonnet 130 is closed.

The front wall 138 has a flange 159 on which is mounted a hasp 161. When the bonnet 130 is closed the aperture 163 in the hasp engages a spring mounted latch, not shown, projecting from the coin operated mechanism 170 mounted on the side wall 136 of the fixed section 132 of the bonnet 130.

As discussed above, the locking mechanism can be mechanical or electromechanical. The bonnet can be slidingly mounted on one or more posts and be raised and lowered vertically to accept and store clubs.

The lockers would be used at golf courses near practice greens, restaurants, pro shop, etc. by patrons to increase the level of prevention of theft when the patron leaves his golf bag unattended.

It is to be realized that only preferred embodiments of the invention have been described and that numerous substitutions, modifications and alterations are permissible without departing from the spirit and scope of the invention as defined in the following claims.

What is claimed is:

1. A storage locker for a golf bag having a top end and a bottom end with golf club heads and shafts extending from the top end of the bag comprising in combination a base having a cavity for receiving the bottom end of a golf bag;

a bonnet having a closed top wall connected to side walls forming an enclosure for receiving and enclosing the club heads extending from the top end of a golf bag;

a first vertical support member connected to the base; and a second vertical support member having a first end telescopically connected to the first vertical support member and a second end rotably connected to a side wall of the bonnet, whereby said bonnet can be raised vertically and rotated horizontally away from the club heads for insertion and removal of a golf bag and clubs from the storage locker.

2. A storage locker according to claim 1 further including means for locking the bonnet when the bonnet is positioned over the base.

3. A storage locker according to claim 2 further including a coin operated mechanism for operating said locking means.

4. A storage locker according to claim 2 in which the means for locking includes:

a laterally, translatable pin mounted on one support member and an aperture in the other support member for receiving the pin whereby the support members are locked.

5. A storage locker for a golf bag having a top end and a bottom end with golf club shafts and heads extending from the top end of the bag comprising in combination:

a base having side walls forming a cavity for receiving the bottom end of a golf bag;

a bonnet having a first section formed of a back wall having a first vertical edge and a second vertical edge, the first vertical edge being joined to a first vertical edge of a first side wall, said first side wall having a second vertical edge and a second section formed of a front wall having a first vertical edge fixedly joined to a vertical edge of a second side wall, all of said walls having top edges and a top wall joined to the top edges of the walls of one of the sections;

the second vertical edge of the back wall being hingedly joined to the second vertical edge of the first side wall such that the first section rotates to close the bonnet to form an enclosure with the second vertical edge of the front wall in contact with the second vertical edge of the second side wall;

a vertical post member connected to the base and to the back wall of the enclosure.

6. A storage locker according to claim 5 further including means for locking said sections of walls together.

7. A storage locker according to claim 6 further including a coin operated mechanism means for operating said locking means.

* * * * *